US005465767A

United States Patent [19]

Harms et al.

[11] Patent Number: 5,465,767

[45] Date of Patent: Nov. 14, 1995

[54] PREMEASURED FLUIDS PACKAGING, STORING AND DISPENSING APPARATUS AND METHOD

[75] Inventors: Frank H. Harms, Marietta, Ga.; Edwin D. Neas, Ft. Collins, Colo.

[73] Assignee: LifeSource Advanced Bloodbank Systems, Inc., Atlanta, Ga.

[21] Appl. No.: 189,980

[22] Filed: Feb. 1, 1994

[51] Int. Cl.[6] ..... B65B 1/04; B65B 3/04

[52] U.S. Cl. ..... 141/237; 141/243; 141/10; 141/114; 53/412; 53/455; 53/133.2; 53/562; 222/541.9

[58] Field of Search ..... 141/237, 240, 141/242, 243, 244, 114, 10, 82, 68, 166, 234, 313, 98, 325; 53/412, 410, 455, 452, 133.2, 133.1, 562, 546; 222/541, 129, 94; 128/760, 762, 764

[56] References Cited

U.S. PATENT DOCUMENTS

| | | | |
|---|---|---|---|
| 2,894,510 | 7/1959 | Bellamy, Jr. | 128/272 |
| 2,968,396 | 1/1961 | Pratt | 53/412 |
| 3,494,351 | 2/1970 | Horn | 128/762 |
| 4,676,256 | 6/1987 | Golden | 128/762 |
| 4,850,912 | 7/1989 | Koyanagi | 441/40 |
| 4,856,261 | 8/1989 | Hackett et al. | 53/469 |
| 4,921,137 | 5/1990 | Heijenga | 222/541 |
| 5,261,466 | 11/1993 | Koyanagi | 141/237 |

*Primary Examiner*—Henry J. Recla
*Assistant Examiner*—Steven O. Douglas
*Attorney, Agent, or Firm*—Warren L. Franz

[57] ABSTRACT

A system for packaging, storing and dispensing discrete quantities of fluid has front and back sheets of fluid impervious material bonded together along seal lines to define a plurality of tubular containment channels including fill ports and discharge ports, and to define a filling manifold including a common fill port connected by a conduit to the separate fill ports. Each discharge port is provided with a frangibly capped, hollow dispensing tube and the seal lines further define cuffs releasably sealed about the dispensing tubes. After the channels are filled with fluid introduced at the common fill port, the sheets are further bonded to close the fill ports, and the filling manifold portion is removed. The remaining portion can then be separated at perforations into individual packets which can be separated by removing the cuff seal, inserting the dispensing tube into a destination container, surrounding the container mouth with the cuff to avoid contamination, and breaking the frangible cap to open the discharge port. Stiffeners with pull tabs are provided to separate the cuff flaps.

20 Claims, 2 Drawing Sheets

PREMEASURED FLUIDS PACKAGING, STORING AND DISPENSING APPARATUS AND METHOD

The present application relates generally to apparatus and methods for packaging, storing and dispensing measured quantities of fluids or fluid suspensions (hereafter collectively referred to as "fluids"); and, in particular, to a thermal processing compatible system for commonly packaging and storing, and individually hygienically dispensing, a plurality of premeasured units of such fluids.

BACKGROUND OF THE INVENTION

Current applications for many chemicals and biological substances require the use of a pipette to transfer measured quantities of these substances from the containers in which they were purchased to the containers in which they will ultimately be used. In the case of some biological substances, this presents a substantial contamination risk. The contamination risk applies both to the substances remaining in the purchased container and to those transferred to the ultimate use container. This contamination risk involves not only the potential loss of the experiment or long-term procedure being carried out, but substantial dollar risk as well, since the chemicals or biological substances that may be contaminated can be very costly (viz. over $100.00 per 500 ml bottle).

The risk of contamination is incurred by opening the bottle, inserting a pipette into the bottle, and subsequently inserting the same pipette into the ultimate use container. All of these operations, even when carried out under a sterile hood, can allow particulate, bacterial, or viral contamination to the initial bottle and/or the ultimate use container. A fixed wall pipette must draw air into its upper end as it empties. This influx of air can add to the contamination hazard as it impinges upon the chemicals or biological materials being dispensed. These problems are compounded when research personnel fail to observe proper sterile procedures such as wearing sterile gloves, performing such transfers under a sterile hood, utilizing sterile pipettes, and changing pipettes between transfers.

The basic technique of pipetting to transfer precise quantities of a liquid is cumbersome, inherently non-sterile and time-consuming. To help alleviate these problems, prior art in this area encompasses an array of mechanical devices and methodologies, none of which address the underlying problem of eliminating the need to pipette at all. For example U.S. Pat. No. 4,748,859 discloses a disposable pipette tip; U.S. Pat. No. 5,223,218 concerns control of an automated pipetter; and U.S. Pat. No. 5,210,927 relates to a pipette filter inserter.

The use of disposable glass pipettes for such transfers constitutes a "sharps" disposal problem since they cannot be cleaned and reused cost-effectively. This "sharps" hazard is of particular concern when the pipettes in question have been used to transfer toxic chemicals or biohazardous materials. Such "sharps" must be disposed of in an approved manner, which can be very expensive and cumbersome.

Many chemicals or biological materials are stored in a frozen state or kept refrigerated and must be warmed to room temperature prior to use. It has been shown that, when freezing and thawing biological materials such as blood plasma, improvements of up to 30% in recoverable protein levels can be achieved by rapid freezing and thawing, as compared to conventional freezing and thawing methodologies. Since, in many instances, less than the entire contents of the container may be used for each application, the contents are subject to repeated thawing/freezing or warming/cooling cycles. These repeated, comparatively slow, thermal cycles can degrade the chemicals or biological substances and are very time-consuming when the materials are stored in 500 ml or 1 liter bottles.

Many chemicals or biological substances have high vapor pressures and tend to lose their constituent gases unless stored in gas-tight environments. The loss of these constituent gases affects the pH of the chemicals or biological substances and renders them useless.

Finally, some chemicals or biological substances are light sensitive and must be kept shielded from light. Exposure to light can cause the chemicals or biological substances to decompose and render them useless.

SUMMARY OF THE INVENTION

It is an object of the present invention to provide apparatus and methods for the sterile, convenient and economical packaging, storing and dispensing of premeasured quantities of chemical and biological fluids which overcome the disadvantages and limitations of pipetting and other conventional systems described above.

It is another object of the present invention to provide apparatus and methods for the sterile transfer of fluid chemical and biological substances between original and destination containers, without contaminating either container and without presenting a "sharps" disposal problem.

It is another object of the invention to provide apparatus and methods for the convenient and economical common sterile packaging of fluids in individually thermally processable, separable premeasured quantity units.

It is a further object of the invention to provide apparatus and methods for the long term frozen or refrigerated storing of separable quantities of chemical or biological fluids without loss of constituent gases or change in pH.

In accordance with the invention, a packaging assembly comprises front and back thin flexible sheets of fluid impervious film material bonded to define a plurality of containment tubes, commonly connected at upper ends for simultaneous filling with fluid through a common filling port. Opposite ends of the containment tubes include discharge ports surrounded by sterile cuffs defined by portions of the sheets left unbonded. Bottom edges of the sheets are releasably joined by a seal to maintain sterility prior to utilization. Outside surfaces of cuff portions of the sheets are provided with tabs for separating the cuff flaps after removal of the seal. Dispensing tubes including selectively actuable closure valves are associated with the discharge ports. The sheets are perforated between containment tubes.

The containment tubes have predefined volume capacities which are filled through the common filling port. The tubes are then isolated into separate units by heat sealing the tops of the tubes and removing the filling manifold portion of the container assembly. The assembly, thus, presents a plurality of isolated tubular units of premeasured quantities of liquid, able to be commonly thermally processed and stored and able to be divided into separate unit packets by tearing along the perforations. For transferring the premeasured fluid contents of one of the separated units into a destination container, the sterile cuff portions are overlapped annularly about the mouth of the destination container, and the dispensing tube is inserted into the destination container before opening the valve.

The system of the invention enables the sterile, economical and convenient common storage of separable units of premeasured quantities of chemical and biological substances. The sterile cuffs serve to enable the transfer of chemicals and biological substances from individual ones of the containment tubes, without contaminating the material in other tubes, and without contaminating material already in the destination use container. Using separable tubes containing. premeasured quantities enables the transfer of measured amounts to occur without the consumption of time and utilization of materials required for measurements and transfer done by pipette. The use of bonded sheets of flexible film for the container assembly enables thermal processing for rapid freezing and/or thawing, either commonly or individually of a premeasured amount. Such flexible material also allows the containment tubes to collapse while emptying completely, and does not require air to be sucked back into the tube, as occurs with rigid pipettes. The individual prepackaging of known quantities enables storage over long periods of time, without loss of constituent gases or change in pH and, for substances which have high vapor pressures, it enables the premeasured amounts to be recovered, without concern for the remaining substance in other tubes. The material of the container assembly can be chosen according to the containment and storage requirements of the particular substance contained (for example, the material can be chosen to inhibit degradation due to light of light sensitive chemicals), and for ease of disposal of the discarded individual packets after use.

BRIEF DESCRIPTION OF THE DRAWINGS

Embodiments of the invention have been chosen for purposes of illustration and description, and are shown with reference to the accompanying drawings, wherein.

Throughout the drawings, like elements are referred to by like numerals.

DETAILED DESCRIPTION OF THE PREFERRED EMBODIMENTS

Figure 1:
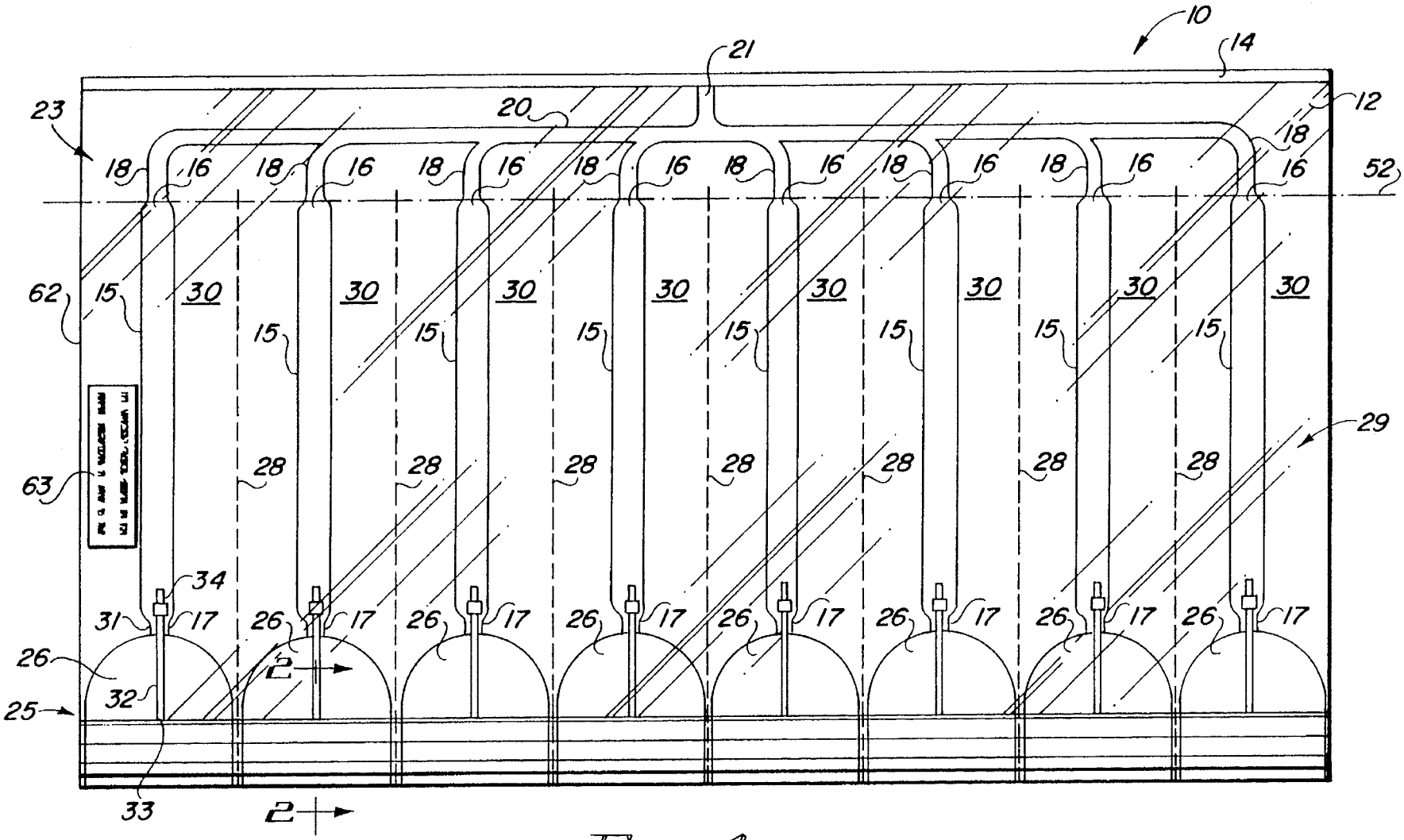
FIG. 1 is a plan view of a container assembly in accordance with the principles of the apparatus of the invention, usable in practicing the method of the invention.
Figure 2:
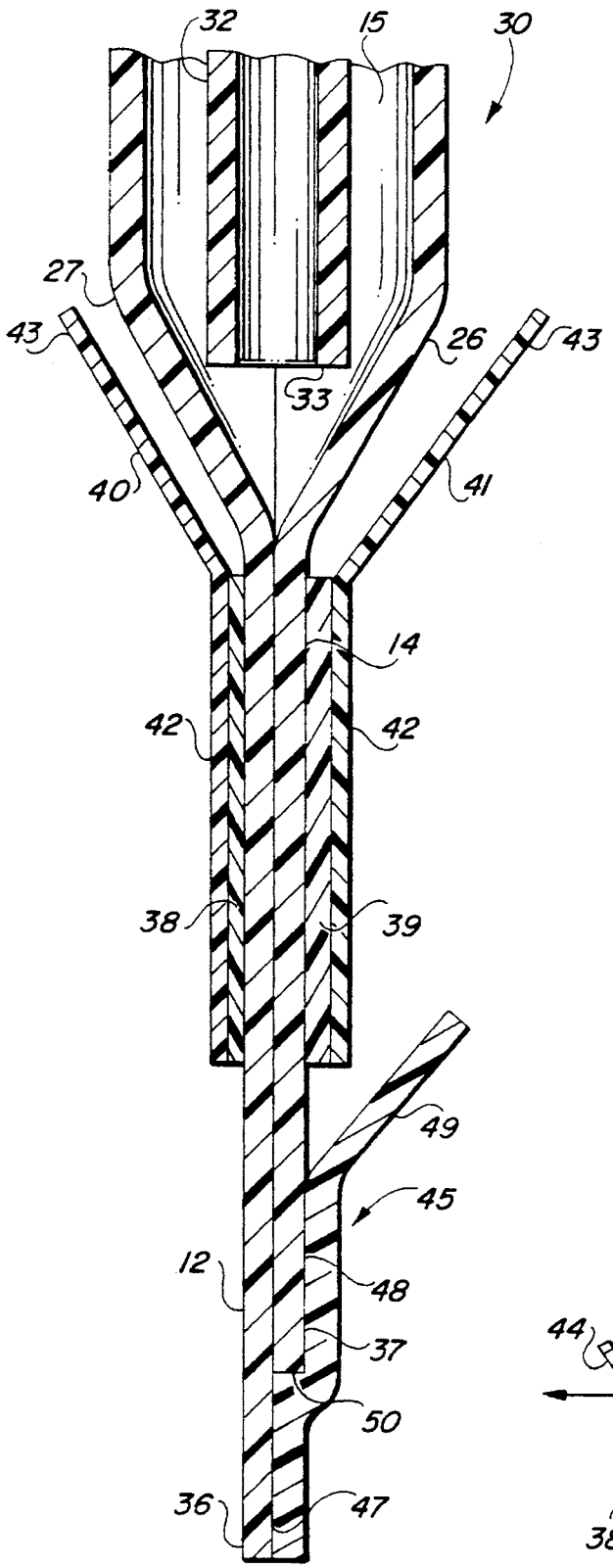
FIG. 2 is an enlarged lateral section view, taken along the line 2—2 of FIG. 1.

An exemplary implementation of a sterile fluid packaging, storing and dispensing system in accordance with the invention utilizes a composite bag or container assembly 10, such as shown in FIGS. 1 and 2. Assembly 10 comprises front and back rectangular sheets 12, 14 of fluid impervious flexible plastic film material, placed in laterally stepped superposed relationships, and bonded together along seal lines, such as by electronic heat welding, to define a plurality of longitudinally evenly-spaced, identical laterally extending tubular containment channels 15 of identical preestablished volume capacity. Each tubular channel 15 has an upper end with a fill port 16, and a lower end with a discharge port 17. The fill ports 16 of the respective containment tubes 15 are initially open and are respectively communicated with laterally extending filling runners 18 that connect through a common longitudinally extending filling conduit 20 to a global fill port 21. Runners 18, conduit 20 and port 21 are all defined by internal regions of sheets 12, 14 left unbonded between heat seals and located within an upper filling manifold portion 23 of the bag. Fill port 21 may be outfitted with a suitable manifold connector, such as a conventional quick disconnect port assembly with sterile cap, which is installed within fill port 21. A lower portion 25 of assembly 10 located below the level of discharge ports 17 is formed to provide a plurality of protective cuffs or shields 26, respectively diverging outwardly and downwardly for a distance from each discharge port opening 17. Each cuff 26 comprises front and back cuff flaps 27 (FIG. 2) defined by arcuate, downwardly expanding unbonded regions of the sheets 12, 14.

To make packets 30 (see FIG. 1) separable into individual components, lines 28 are cut with a perforating die longitudinally, centrally between adjacent containment tubes 15 from points above fill ports 16 but below filling conduit 20, laterally all the way down to the lower end bag extremity. Lines 28 define the outer limits of cuffs 26 and divide middle 29 and lower portions 25 of the bag into a side-by-side series of adjacent containment packets or units 30.

Each discharge port 17 is fitted with a frangibly capped, hollow dispensing tube that closes the opening of the discharge port 17. Breaking the frangible cap allows the discharge of fluid from the cavity of channel 15 out of port 17 through tube 32. For the illustrated embodiment, discharge port 17 is fitted with a polyethylene sleeve 31 having a central bore through which a hollow acrylic dispensing tube 32 is passed that closes the opening of the discharge port 17. Tube 32 extends a distance below sleeve 31 and has an open bottom end 33. The top end of tube 31 is closed at an enlarged portion 34 located above sleeve 31, which takes the form of a frangible seal located within the bottom of containment tube 15. Enlargement 34 can be broken off above a score line to unseal the top of tube 32, to effect discharge of fluid. If preferred, the frangible portion can be located below sleeve 31 to keep it away from the working volume of containment tube 15, and a piece added to capture or contain the breakaway portion.

As seen in FIG. 2, unbonded portions of sheets 12, 14 forming cuffs 26 extend laterally below the open bottom ends 33 of tubes 32 and terminate at respective laterally stepped, overlapping longitudinal bottom edges 36, 37. Stiffeners 38, 39 are respectively attached to outer surfaces of sheets 12, 14 in longitudinally extending strips which run the full length of bag 10, adjacent edges 36, 37. Pull tabs 40, 41 extend longitudinally coextensively over stiffeners 38, 39, with lower portions 42 bonded to the stiffeners 38, 39 and upper portions 43 left free. Sheets 12, 14 are releasably joined at stepped edges 36, 37 by a common sterile seal strip 45 which extends longitudinally, below stiffeners 38, 39, for the full length of bag 10. Strip 45 includes a first longitudinally extending zone 47 having an inner face bonded by a releasable sterile adhesive to the inner surface of sheet 12 along edge 36; a second, longitudinally extending zone 48, laterally shifted upwardly from zone 42, having an inner face similarly releasably bonded to the outer surface of sheet 14 along edge 37; and a third, longitudinally extending free zone 49, laterally shifted upwardly from zone 48, which remains unconnected. A shoulder 50 is formed between zones 47, 48 to provide an outward step to accommodate the thickness of sheet 14. Other sealing means can also be utilized.

In accordance with an exemplary method of the invention, a fluid chemical or biological substance 51 (FIG. 3) is introduced at global fill port 21, to simultaneously fill the containment tubes 15 each with an identical quantity of the substance. Because containment tubes 15 are identically sized and filled under the same temperature and pressure conditions, each will hold the same preestablished known volume between initially closed discharge port 17 and initially open fill port 16. When each channel 15 has been filled with a desired identical quantity of fluid, the fill ports 16 are sealed by heat welding front and back sheets 12, 14 together, along a longitudinal seal line, shown by dot-dashed line 52 in FIG. 1. The filling manifold portion 23 of assembly 10 can thereafter be removed from the remainder of assembly 10, such as by cutting assembly 10 above seal line 52. The filled assembly now comprises a plurality of identically filled individual packets 30, releasably joined together along perforation lines 28. The perforations 28 are made after the stiffener and seal strips 38, 39, 45 have been applied so that tearing along the perforations will segment the strips 38, 39, 45 when the individual packets 30 are separated.

Figure 3:
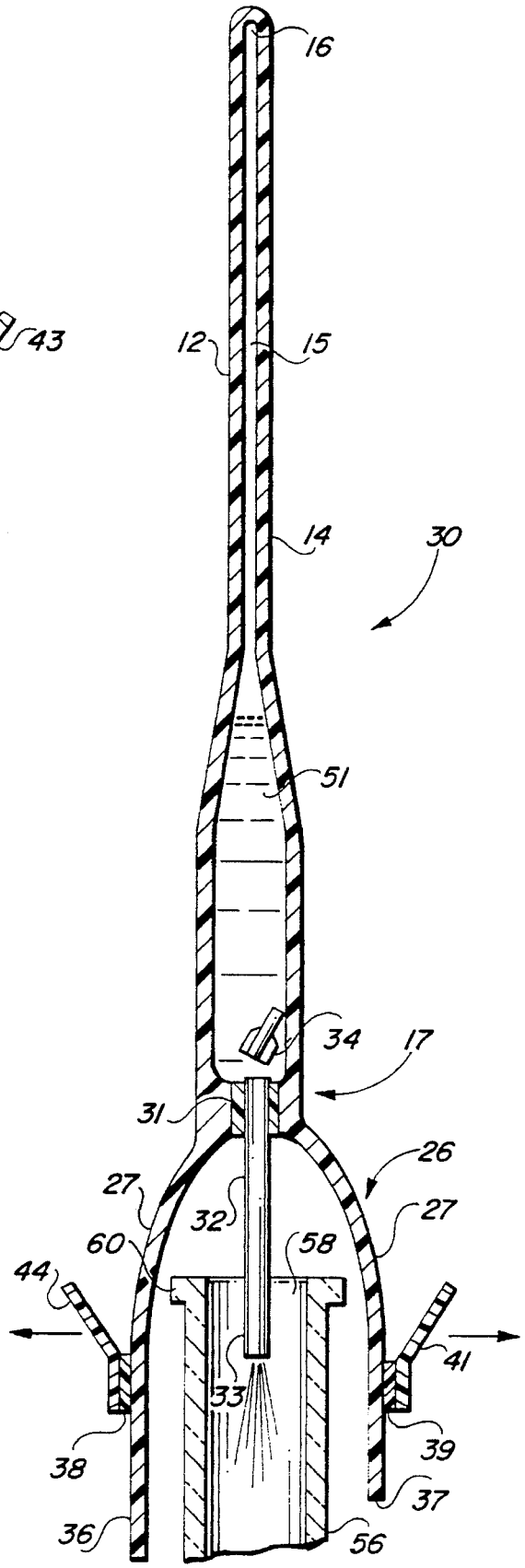
FIG. 3 is a lateral section view, showing a separated containment tube unit in place for transfer of a premeasured quantity of substance into a destination container.

The filled assembly 10 can now be thermally processed to commonly freeze or refrigerate the joined packets 30 for storage. When some of the substance is needed for use, one or more of the packets 30 can be severed along perforations 28 from the remainder of the assembly 10, and thawed or warmed to a desired room or elevated temperature. To dispense the premeasured quantity of contained fluid out from one of the channels 15, to transfer it to another destination container 56, the packet 30 is brought into a position as shown in FIG. 3. The laterally stepped bottom edges 36, 37 of sheets 12, 14 are unjoined by pulling on the free zone 49 of the severed segment of sealing strip 45, to remove the strip from the packet 30. The front and back portions of sterile cuff 26 are then separated by pulling outwardly in opposite directions on pull tab segments 40, 41, respectively attached to the outside surfaces of sheets 12, 14. Packet 30 is then positioned over a fill opening 58 of destination container 56, with bottom end 33 of dispensing tube 32 passing through the mouth of opening 58 into container 56, and the inside of cuff 27 annularly enveloping the outside of the mouth of opening 58, around lip 60. The frangible seal 34 is then broken to open port 17, and the premeasured contents of containment tube 15 of packet 30 are then emptied through tube 32 into destination container 56. The flaps 27 of cuff 26 act to cover opening 58 during fluid transfer, to shield both the transferred fluid 51 and destination container 56 from contaminants. Because the material of sheets 12, 14 is flexible, the containment tube 15 collapses as it empties and can be compressed, if necessary, to expel its contents. This minimizes contact of the dispensed fluid with air.

The individual containment tubes 15 can be manufactured to any size capacity (viz. 5 to 500 ml) by altering the longitudinal distance between laterally extending seal lines, or lateral distance between upper and lower ends of tubes 15. Tubes 15 can be made of identical size, as described above, or of different sizes. The configurations of filling runners 18 and other components of manifold portion 23 of assembly 10 can likewise be varied to suit individual needs and preferences. The manifold connector allows sterile attachment to virtually all filling systems. When the containment and dispensing system established by the remainder of assembly 10 is filled, sealing the runners 23 at seal 52 to close fill ports 15 can be done so that manifold portion 23 remains sealed when cut away from the rest of bag 10, thereby allowing any chemicals or biological materials remaining in manifold 23 to be recovered. This can be done, for example, by establishing wide or double seal line 52 and cutting at the center or between the seals.

Because the individual tubes 15 remain separate, once the filling manifold 23 has been removed, there can be no cross-contamination between the separate premeasured units. The interval of flat joined film material between each containment tube 15 and the adjacent perforation 28 or bag lateral edge 62 can be utilized for labels or other descriptive material 63.

The sterile connecting cuffs 26 lie flat when not in use, but are expanded to round shapes by pulling on the sterile cuff tabs 40, 41 located on either side of the cuffs 26. The cuffs 26, in their rounded or open configurations, are dimensioned and configured to fit conveniently over the mouths of the anticipated ultimate use containers 56, so that the mouths are completely covered to prevent unsterile and particulate material from falling into the container 56. Cuffs 26 can be formed to any size to accommodate any opening in any ultimate use container by altering the seal lines that create them. Likewise, dispensing tubes 32 can be configured to adapt to any container 56. Sterile seal 45 may be constructed to be either fully of only partially removable. For example, it is sufficient that only zone 47 be separated from the seal in order to allow a cuff 26 to fit over the opening in a destination container 56. Once cuff 26 is positioned over opening 58 of container 56, with dispensing tube 32 inserted into container 56, frangible port 34 is broken to release the premeasured quantity of stored material. Frangible port 34 may be of a standard type known to those skilled in the art of construction of containers for transfusion liquids.

As noted above, pulling on the spreader tabs 40, 41 causes cuff 26 to assume a round shape, once sterile seal 45 is removed or opened. The stiffeners 38, 39 serve to prevent the front and back film sheets 12, 14 from collapsing or folding inward as cuff 26 is placed over the mouth of destination container 56. It will be appreciated that the configurations of cuffs 26, tabs 40, 41 and stiffeners 38, 39 can all be varied to suit particular needs and preferences.

Those skilled in the art to which the invention relates will appreciate that other substitutions and modifications can also be made to the described embodiment, without departing from the spirit and scope of the invention as described by the claims below.

What is claimed is:

1. Apparatus for packaging, storing and dispensing discrete quantities of fluid, said apparatus comprising:

front and back flexible sheets of fluid impervious material;

a plurality of tubular containment channels including discharge ports and defined by first seal lines bonding said sheets together;

means, including a common fill port and defined by second seal lines bonding said sheets together, for filling said channels with fluid introduced at said common fill port;

dispensing tubes, respectively fluidically connected with said channels at said discharge ports, for dispensing said fluid from said channels through said discharge ports;

valve means for selectively controlling said dispensing by said dispensing tubes; and cuffs, respectively surrounding said dispensing tubes and defined by third seal lines bonding said sheets together, said cuffs being dimensioned, configured and adapted for surrounding an opening of a destination container when said corresponding dispensing tube is inserted into said opening for said dispensing.

2. Apparatus as in claim 1, further comprising means located on said sheets between adjacent ones of said channels, for selectively separating said apparatus into individual channel packets.

3. Apparatus as in claim 2, wherein said means for separating comprises perforation lines.

4. Apparatus as in claim 1, wherein said valve means comprises frangible caps respectively provided on said dispensing tubes.

5. Apparatus as in claim 1, wherein said cuffs comprise front and back flaps respectively defined by unbonded regions of said first and second sheets located between said third seal lines and having arcuate configurations expanding away from said discharge ports.

6. Apparatus as in claim 5, further comprising stiffeners respectively attached to outer surfaces of said front and back flaps, and pull tabs having portions bonded to said stiffness and unbonded portions left free.

7. Apparatus as in claim 1, wherein said channels also include respective individual fill ports, and said filling means comprises a filling manifold including said common fill port and further including a common filling conduit fluidically connected to said common fill port and a plurality of filling runners respectively connecting said individual fill ports to said common filling conduit.

8. Apparatus as in claim 7, wherein said individual fill ports are open; and wherein said first, second and third seal lines are dimensioned, configured and located so that said individual fill ports can be closed by further bonding said sheets together along at least one fourth seal line after said filling, and said sheets can thereafter be divided proximate said at least one fourth seal line to separate said filling manifold from said channels and cuffs.

9. Apparatus as in claim 1, further comprising means releasably sealing said dispensing tubes within said cuffs.

10. Apparatus as in claim 9, wherein said sealing means comprises a seal strip which extends along adjacent peripheral respective edges of said sheets.

11. Apparatus as in claim 10, wherein said sheets have inner and outer surfaces, and wherein said seal strip comprises a first zone bonded to said inner surface along said peripheral edge of one of said sheets and a second zone bonded to said outer surface along said peripheral edge of the other of said sheets.

12. Apparatus as in claim 11, wherein said one sheet peripheral edge is stepped relative to said other sheet peripheral edge, said other sheet has a thickness, and said seal strip has a shoulder formed between said first and second zones and dimensioned to match said thickness.

13. Apparatus as in claim 12, wherein said seal strip further includes a third zone adjacent said second zone and extending in unbonded relationship along said other sheet outer surface.

14. Apparatus as in claim 1, wherein said channels are identical channels elongated in a first direction and evenly-spaced in a second direction, normal to said first direction.

15. Apparatus as in claim 1, wherein said apparatus further comprises sleeves respectively fitted within said discharge ports and including bores; said dispensing tubes pass through said sleeve bores; and said valve means comprises frangible caps located on said dispensing tubes.

16. Apparatus for storing and dispensing discrete quantities of fluid, said apparatus comprising:

front and back sheets of fluid impervious material bonded together along seal lines to define a plurality of tubular containment channel packets, each channel packet having a discharge port with an opening;

said sheets being further bonded together along other seal lines to define a plurality of cuffs respectively diverging outwardly for a distance away from said discharge port openings; said cuffs being expandable to present shields for completely annularly surrounding discharges of fluid from said channel packets through said port openings respectively; and said apparatus including means located on said sheets between adjacent ones of said channels, for selectively separating said individual channel packets.

17. Apparatus as in claim 16, further comprising a plurality of hollow dispensing tubes respectively fitted within said discharge ports; and means releasably sealing said dispensing tubes within said cuffs; said tubes including frangible caps closing said openings, and said caps being dimensioned, configured and positioned so that breaking said caps opens said openings to enable said discharges to occur through said tubes.

18. Apparatus as in claim 17, wherein said cuffs comprise front and back flaps respectively defined by unbonded regions of said first and second sheets between said other seal lines; and further comprising stiffeners respectively attached to said flaps; and pull tabs on said stiffeners for separating said flaps; said tabs acting to separate said flaps when pulled in opposite directions, and said stiffeners serving to prevent said flaps from collapsing after separation.

19. A method for providing discrete quantities of fluid, said method comprising the steps of:

superposing front and back sheets of fluid impervious material;

bonding said sheets together along first seal lines to define a plurality of tubular containment channels including normally closed discharge ports and normally open individual fill ports;

bonding said sheets together along second seal lines to define a global fill port and conduit means communicating said global fill port commonly with said individual fill ports;

bonding said sheets together along third seal lines to define a plurality of cuffs respectively diverging outwardly for a distance away from said discharge ports;

filling said channels with fluid communicated through said global fill port to said individual fill ports;

after said filling step, bonding said sheets together along at least one fourth seal line to close said individual fill ports; and after said filling step, dividing said sheets to separate a portion of said bonded sheets containing said global fill port and conduit means from portions of said bonded sheets containing said channels and said cuffs.

20. A method as in claim 19, further comprising the steps of:

providing frangibly capped dispensing tubes within respective ones of said discharge ports;

sealing said dispensing tubes within said cuffs;

separating a packet containing one channel, cuff and dispensing tube from said channel and cuff portions of said sheets;

unsealing said packet dispensing tube from said packet cuff;

positioning said packet over a fill opening of a destination container with said packet dispensing tube inserted into said opening and said packet cuff annularly surrounding a mouth of said opening;

breaking said frangible cap of said packet dispensing tube; and dispensing said fluid from said packet channel through said dispensing tube into said destination container.

* * * * *